US006827756B2

(12) United States Patent
Park et al.

(10) Patent No.: US 6,827,756 B2
(45) Date of Patent: Dec. 7, 2004

(54) TUNGSTEN HEAVY ALLOY FOR PENETRATING SPLINTER SHELL AND FORMING METHOD THEREOF

(75) Inventors: Kyung Jin Park, Kyeongju-shi (KR); Joo Ha Ryu, Kyeongju-shi (KR)

(73) Assignee: Poongsan Corporation, Seoul (KR)

( * ) Notice: Subject to any disclaimer, the term of this patent is extended or adjusted under 35 U.S.C. 154(b) by 0 days.

(21) Appl. No.: 10/345,968

(22) Filed: Jan. 17, 2003

(65) Prior Publication Data

US 2004/0033155 A1 Feb. 19, 2004

(30) Foreign Application Priority Data

Jul. 13, 2002 (KR) ..... P 2002-0040994

(51) Int. Cl.[7] ..... C22C 1/04
(52) U.S. Cl. ..... 75/248; 102/517
(58) Field of Search ..... 75/248, 255; 102/517; 419/42

(56) References Cited

U.S. PATENT DOCUMENTS 2,793,951 A * 5/1957 Green et al. ..... 419/37
3,656,731 A * 4/1972 Larsen ..... 249/135
3,888,636 A * 6/1975 Sczerzenie et al. ..... 75/248
3,988,118 A * 10/1976 Grierson et al. ..... 75/248
4,801,330 A * 1/1989 Bose et al. ..... 75/248
4,858,531 A * 8/1989 Lindstadt et al. ..... 102/307
5,294,269 A * 3/1994 Lee et al. ..... 148/514
5,740,516 A * 4/1998 Jiranek et al. ..... 428/553
5,863,492 A * 1/1999 Bose ..... 420/430
5,989,494 A * 11/1999 Kapoor ..... 419/54

* cited by examiner

*Primary Examiner*—Ngoclan T. Mai
(74) *Attorney, Agent, or Firm*—Harness, Dickey & Pierce, P.L.C.

(57) ABSTRACT

Disclosed are a tungsten material for a penetrating splinter shell and forming method thereof enabling a penetrator to perforate a hard target on high-speed impact as well as having the following splinter cause a severe damage on an inner component by changing a breakage characteristic of the material into brittle fracture from ductile fracture in a manner that a mechanical characteristic of the material is adjusted by controlling a sintering condition and a composition ratio of a tungsten heavy alloy material having Mo added thereto. The present invention includes the steps of mixing 90~95 wt % W powder, 3.0~8.0 wt % Mo powder, 0.5~3.0 wt % Ni powder, and 1.0~4.0 wt % Fe powder with each other, molding the mixed powders, and sintering the molded powders.

4 Claims, 13 Drawing Sheets

Before corrosion After corrosion

Before corrosion After corrosion (a)

(b),(c),(d)

(e)

Sintering temperature : Max. 1390°C

Sintering temperature : 1410°C

Sintering temperature : 1450°C

Sintering time : 2.0 time

Sintering time : 3.5 time & 5.0 time

TUNGSTEN HEAVY ALLOY FOR PENETRATING SPLINTER SHELL AND FORMING METHOD THEREOF

This application claims the benefit of the Korean Application No. P2002-40994 filed on Jul. 13, 2002, which is hereby incorporated by reference.

BACKGROUND OF THE INVENTION

1. Field of the Invention

The present invention relates to a tungsten heavy alloy applied to a penetrator material of a penetrating splinter shell, and more particularly, to a tungsten material for a penetrating splinter shell and forming method thereof enabling a penetrator to perforate a hard target on high-speed impact as well as having the following splinter cause a severe damage and incendiary effect on an inner component by changing a breakage characteristic of the material into brittle fracture from ductile fracture in a manner that a mechanical characteristic of the material is adjusted by controlling a sintering condition and a composition ratio of a tungsten heavy alloy material having Mo added thereto.

2. Discussion of the Related Art

FIG. 1 illustrates a picture of a typical microstructure (compositional mode of SEM) of 90W-7Ni-3Fe tungsten heavy alloy according to a related art.

Referring to FIG. 1, circular grains are tungsten of body-centered cubic(BCC) unit cells and a portion, which surrounds the circular grains and in which solid solution of the tungsten is contained in part, is a matrix of Ni—Co—Fe—W alloy of face-centered cubic(FCC) unit cells.

The material is a kind of composite constructed with a tungsten particle having a hard property and the matrix having a soft property.

Meanwhile, the material is prepared by liquid phase sintering. The prepared pellet is maintained at 1,000~1,300° C. for a predetermined time(2~10 hours), a series of water quenching is carried out on the pellet repeatedly, a cold rolling process is carried thereon, and the pellet is then aged.

The pellet prepared by the above method is widely used as a penetrator material of a kinetic energy projectile as well as is applied to other civilian industry fields of weight balance, radiation shield, processing tool, and the like.

Depleted uranium(hereinafter abbreviated DU) is currently used as a material of an armored plate breaking penetrator as well as the tungsten heavy alloy material.

It is known that material physical properties of DU is superior to those of tungsten heavy alloy as well as that penetration performance of DU is superior to that of tungsten heavy alloy approximately 10%. The reason why the penetrating performance of DU is superior to that of tungsten heavy alloy is that a behavior of high-speed transformation of DU is different from that of tungsten heavy alloy. A difference between the high-speed transformation behaviors of the two materials is shown in FIG. 2A and FIG. 2B.

Namely, tungsten heavy alloy, as shown in FIG. 2B, has severe transformation on penetration so that a cusp of the penetrator is changed into a mushroom shape to increase a diameter of the penetrator. Hence, a penetration resistance increases to reduce the penetrating performance. On the other hand, DU, as shown in FIG. 2A, develops so-called self-sharpening that causes a local fracture easily due to adiabatic shear bend at an edge of the cusp of the penetrator. Hence, a diameter of the penetrator of DU becomes smaller than that of tungsten heavy alloy so that a penetration resistance of DU is lowered than that of tungsten heavy alloy. Therefore, the penetrating performance of DU is relatively increased.

There are several disadvantages to using DU, such as hydrogen brittleness, corrosion, environmental pollution, related medical illness, and the like. Therefore, notwithstanding that DU is superior to tungsten heavy alloy in penetrating power, the latter is on the balance more suitably useable.

Specifically, environmental pollution and badness for human healthcare are fatal so that there are many limitations on use of DU.

Military arms are variously developed lately to make use of the tungsten heavy alloy material for the kinetic energy projectile as attacking arms systems for missile defense, anti-ship, and anti-craft in Navy. Specifically, a penetrating splinter shell having multi-functions of splinter diffusion penetration and incendiary effect is badly demanded.

Meanwhile, unlike the penetrating mechanism of target penetration by self-sharpening of the penetrator itself, a W—Cu material is known well for the target penetration by splinter diffusion. Yet, when considering the relative correlation of tensile strength and compression yield strength of the W—Cu material, is to apparent that the tensile strength is, relatively, too high. Hence, the W—Cu material fails to be superior to that of the present invention in the splinter-diffusion penetrating performance.

SUMMARY OF THE INVENTION

Accordingly, the present invention is directed to a diffusing-splinter penetration type tungsten heavy alloy penetrator material that substantially obviates one or more problems due to limitations and disadvantages of the related art.

An object of the present invention is to provide a diffusing-splinter penetration type tungsten heavy alloy penetrator material enabling penetration of a target not by self-sharpening of a penetrator itself but by diffusing splinters.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a diffusing-splinter penetration type tungsten heavy alloy penetrator material according to the present invention includes 90~95 wt % W powder, 3.0~8.0 wt % Mo powder, 0.5~3.0 wt % Ni powder, and 1.0~4.0 wt % Fe powder.

In another aspect of the present invention, a method of forming a diffusing-splinter penetration type tungsten heavy alloy penetrator material includes the steps of mixing 90–95 wt % W powder, 3.0–8.0 wt % Mo powder, 0.5–3.0 wt % Ni powder, and 1.0–4.0 wt % Fe powder with each other, compacting the mixed powders to form a green blank, and sintering the compacted green blank.

Preferably, the compacting step is carried out by Cold Isostatic Pressing.

Preferably, the sintering step is carried out for 2~5 hours at 1,350~1,450° C.

Preferably, the sintering is carried out at an ambience of none-oxidation or a reducing ambience of hydrogen gas.

The present invention is characterized in that a mechanical characteristic is controlled by an intermetallic compound produced by adjusting an alloy ratio by adding Mo to a tungsten heavy alloy composition and by controlling a sintering condition.

Therefore, the present invention enables to provide a heavy alloy material for a splinter shell suitable for penetrating the target on high-speed impact and causing a severe damage and incendiary effect on an inner component by changing a breakage characteristic of the material into brittle fracture from ductile fracture.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Figure 1:
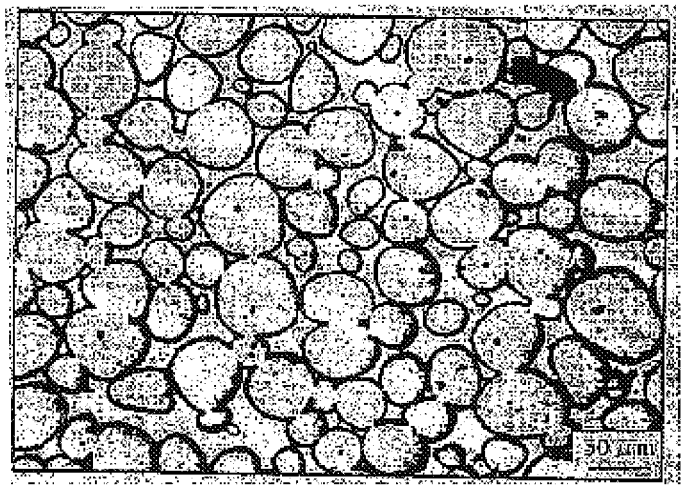
FIG. 1 illustrates a picture of a micro structure (compositional mode of SEM) of 90W-7Ni-3Fe tungsten heavy alloy according to a related art.
Figure 2A:
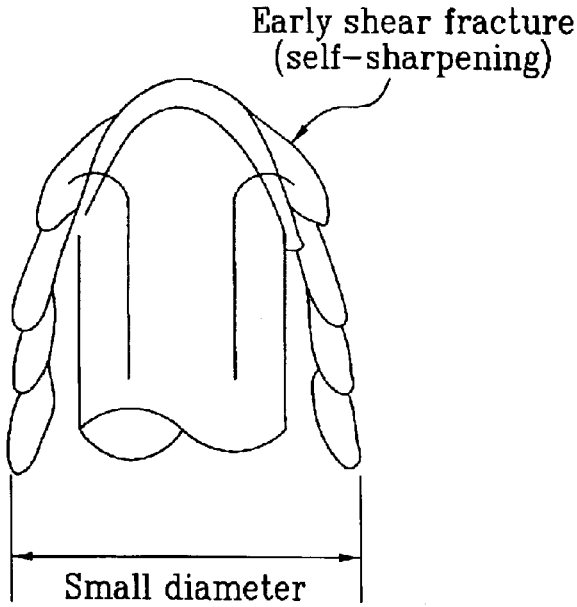
FIG. 2A illustrates a diagram of a transformation behavior generated from a cusp of a uranium(DU) penetrator on high-speed impact.
Figure 2B:
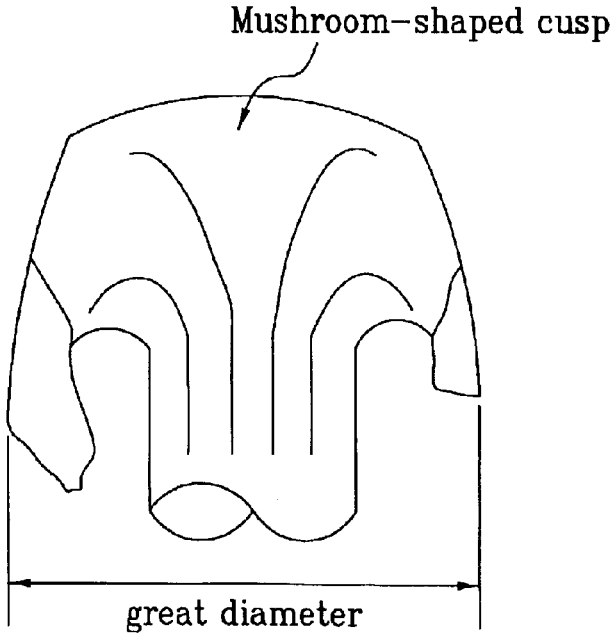
FIG. 2B illustrates a diagram of a transformation behavior generated from a cusp of a tungsten heavy alloy penetrator on high-speed impact.

Reference will now be made in detail to the preferred embodiments of the present invention, examples of which are illustrated in the accompanying drawings. Wherever possible, the same reference numbers will be used throughout the drawings to refer to the same or like parts.

A tungsten heavy alloy material according to the present invention has a Mo content of 3.0–8.0 wt % to increase hardness and compression yield strength but to decrease tensile strength. This is because Mo becomes an intruder into tungsten grains to increase the compression yield strength by causing lots of transformation of the tungsten grains.

Moreover, as the splinter becomes a straight line shape by Mo addition, the tensile strength becomes smaller than the compression yield strength, thereby possibly causing a severe damage and incendiary effect on an inner component for breakage.

This phenomenon occurs in a manner such that a dislocation generated from compression transformation of Mo as an intrusive element having intruding into the tungsten grains is coupled with a tungsten grain. It is known that a new dislocation is generated from a stress-focused point when the dislocation is released by high compression stress or is bound strongly.

A sintering temperature to acquire a material according to the present invention is 1,300–1,500° C., and preferably, 1,300–1,450° C. If the temperature is raised higher, the compression yield strength is reduced but the tensile strength is increased. Hence, a step-like fracture pattern is formed to reduce the breaking characteristic. This means that an intermetallic compound tends to be formed less if cooling is carried out at high temperature instead of low temperature. In this case, brittleness of the material appears less. Moreover, if the sintering temperature is too low, the fracture pattern of the material fails to be straight.

In an aspect of the sintering time, the longer the sintering time fete at the same temperature, the higher the tenacity of the material. The shorter the time becomes, the higher the compression yield strength becomes but the less the tensile strength becomes. Hence, the sintering time of the present invention is preferably 2–5 hours.

The tungsten heavy alloy penetrator material according to the present invention, on which sintering is carried out under the above-explained condition, has such mechanical characteristics as 30–36 of hardness (HRC), 40–75 kg/cm$^2$ (preferably, 47–67 kg/cm$^2$) of tensile strength, and 80–100 kg/cm$^2$ (preferably, 85–95 kg/cm$^2$) of compression yield strength.

First Embodiment

In accordance with the composition of Table 1, four species of sample (a) 93.8W—2.5 Ni—3.7 Fe, sample (b) 93.7 W-1.5Ni-1.8Fe-3.0 Mo, sample (c) 93.1 W-1.1Ni-1.3Fe-4.5 Mo, and sample (d) 92.0 W-0.5Ni-1.0Fe-6.5 Mo are mixed with other. After than, a green blank having a diameter of 25 mm and a length of 350 mm is prepared by Cold Isostatic Pressing. Also the green blank is sintered at a reducing gas ambience of hydrogen using a Pusher type continuous sintering furnace. A tensile sample is prepared from the produced material according to ASTM-E8M FIG. 20 and a compression test sample of Φ10 mm×L10 mm is prepared. Physical property tests are carried out on both of the prepared samples at a test speed of 0.5 mm/min. The test results are shown in Table 1.

Figure 3A:
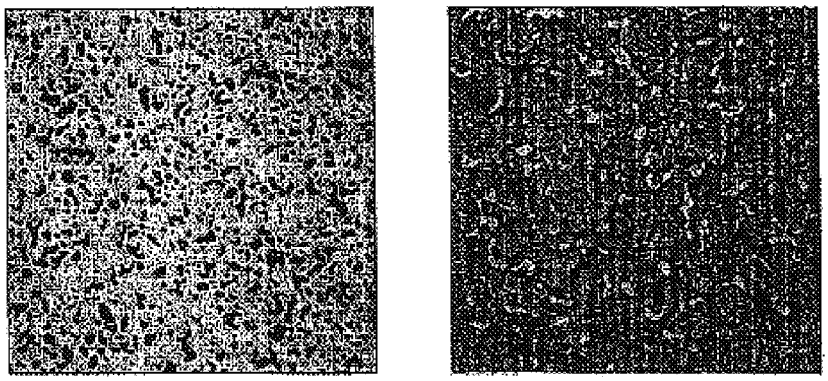
FIG. 3A illustrates microscopic pictures of microstructures of a tungsten heavy alloy material having a splinter diffusion characteristic according to a disclosed W—Cu material.
Figure 3B:
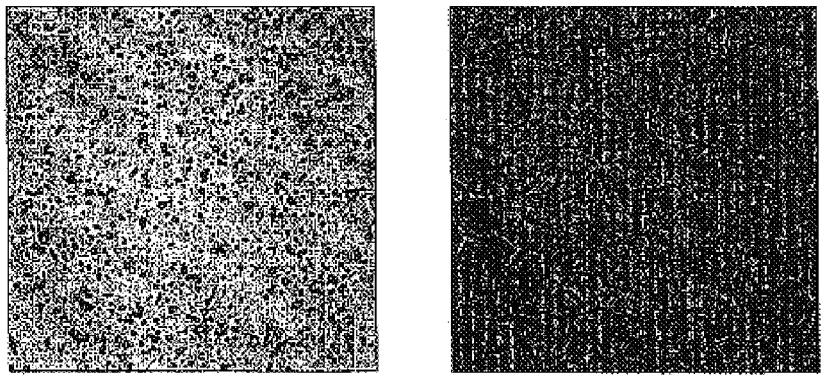
FIG. 3B illustrates microscopic pictures of microstructures of a tungsten heavy alloy material having a splinter diffusion characteristic according to a material of the present invention.

Physical properties change according to composition ratio of raw material powder:

FIG. 3B illustrates microscopic pictures of microstructures of sample (c) having a splinter diffusion characteristic as reflected in Table 1.

Referring to FIG. 3B, as the Mo contents increases like in Table 1, hardness and compression yield strength increase but tensile strength decreases. Since Mo, as an intrusive type, resides in tungsten(W) grains, transformation is greatly given to the tungsten grains to increase the compression yield. Moreover, tensile strength increases due to the incremental contents of Ni and Fe as binding metals since the strength and ductility increase due to the formation of solid solution.

Figure 12A:
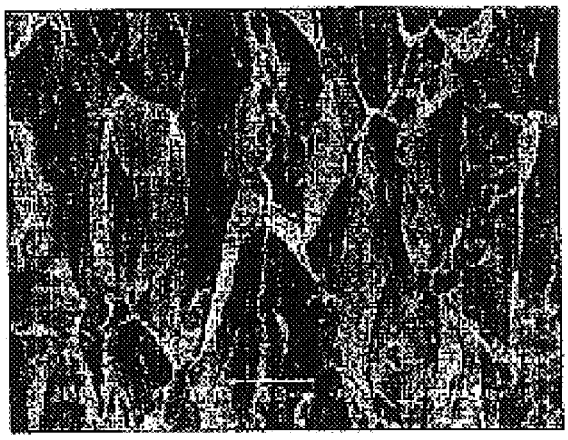
FIG. 12A illustrates a SEM picture of a splinter after compression test of the sample b(93.7W-1.5Ni-1.8Fe-3.0Mo)
Figure 12B:
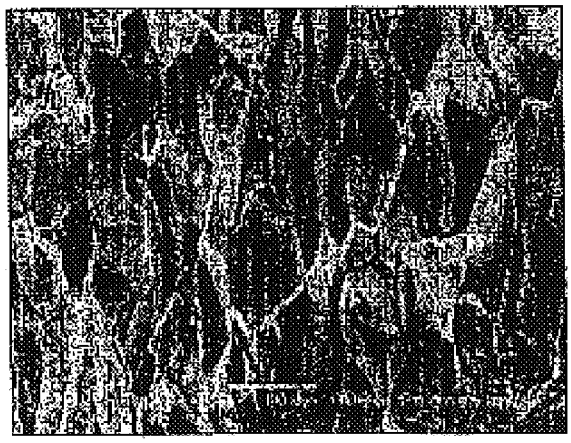
FIG. 12B illustrates a SEM picture of a splinter after compression test of the sample c(93.1W-1.1Ni-1.3Fe-4.5Mo)

FIG. 12A illustrates a SEM picture of a splinter after compression test of the sample (b)(93.7W-1.5Ni-1.8Fe–3.0Mo) and FIG. 12B illustrates a SEM picture of a splinter after compression test of the sample (c)(93.1W-1.1Ni-1.3Fe-4.5Mo).

Referring to FIG. 12A and FIG. 12B, as the Mo content increases, so does a grain size of tungsten, thereby increasing the transformation resistance. Moreover, in an aspect of splinters in the compression test, shear (intererystalline) fracture occurs on breakage since the sample (a) has a step-like tensile strength relatively higher than the compression yield strength. Cleavage fracture occurs in the sample (b), (c), or (d) having a straight-lined tensile strength that is relatively smaller than the compression yield strength.

Figure 5:
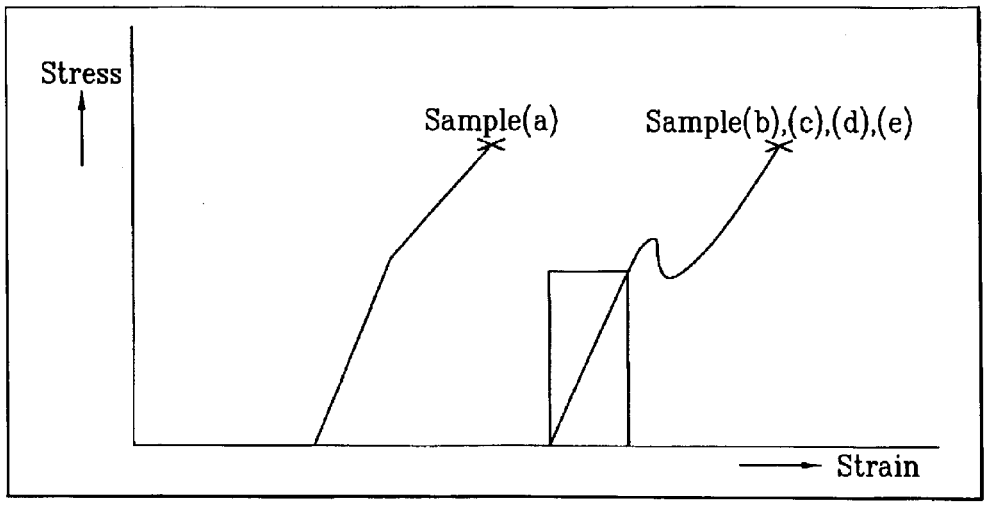
FIG. 5 illustrates a stress-strain graph of a compression strength test for an alloy ratio variation of each sample according to the present invention.

FIG. 5 illustrates a stress-strain graph of a compression strength test for alloy ratio variation in Table 1.

Referring to FIG. 5, the up and down yield phenomena shows up in the samples, (b), (c), and (d). Such phenomena occur in a manner such that a dislocation generated from compression transformation of Mo as an intrusive element intruding into the tungsten grains is coupled with a tungsten grain. It is known that a new dislocation is generated from a stress-focused point when the dislocation is released by high compression stress or is bound strongly.

A splinter count of the material having a yield point in the stress-strain graph is greater than that having no yield point,

TABLE 1

Physical properties change according to composition ratio of raw material powder:

class.

| | Comp. (wt %) | Tensile Strength (kg/mm$^2$) | Hard. ($H_RC$) | Compression test: Compression Yield (kg/mm$^2$) | Compression test: Fracture pattern | Compression test: Splinter count | Compression test: S-S curve | Density (g/cc) | Ref. |
|---|---|---|---|---|---|---|---|---|---|
| (a) | 93.8W-2.5N-3.7Fe-0.0Mo | 84 | 34.0 | 77 | | 10 | | 17.72 | Sintering for 2 hours at 1,410° C. |
| (b) | 93.7W-1.5Ni-1.8Fe-3.0Mo | 58 | 34.5 | 88 | | 8 | | 17.80 | |
| (c) | 93.1W-1.1Ni-1.3Fe-4.5Mo | 53 | 34.5 | 90 | | 12 | | 17.68 | |
| (d) | 92.0W-0.5Ni-1.0Fe-6.5Mo | 43 | 36.0 | 105 | | 13 | | 17.55 | |

and the splinters of the material having the yield point are similar to each other in size. Besides, a fracture pattern of the material having the yield point is a straight line. Hence, numerous splinters (uniform in size) are formed by the penetration test, whereby a penetrating diameter is increased greatly.

Figure 6A:
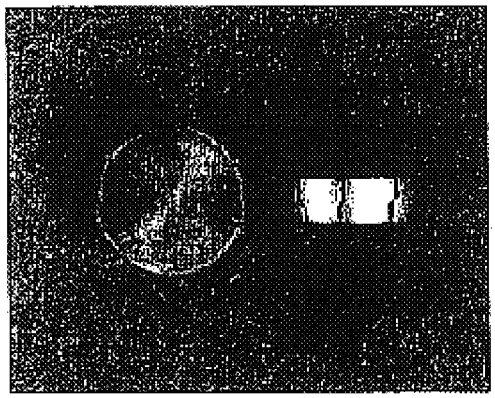
FIG. 6A illustrates a picture of a fracture pattern of sample a(93.8W-2.5Ni-3.7Fe) in FIG. 5.
Figure 6B:
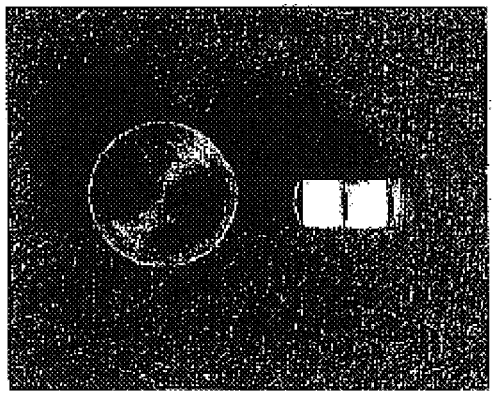
FIG. 6B illustrates a picture of a fracture pattern of sample b(93.7W-1.5Ni-1.87Fe-3.0Mo), sample c(93.1W-1.1Ni-1.3Fe-4.5Mo), and sample d(92.0W-0.5Ni-1.0Fe-6.5Mo) in FIG. 5.
Figure 6C:
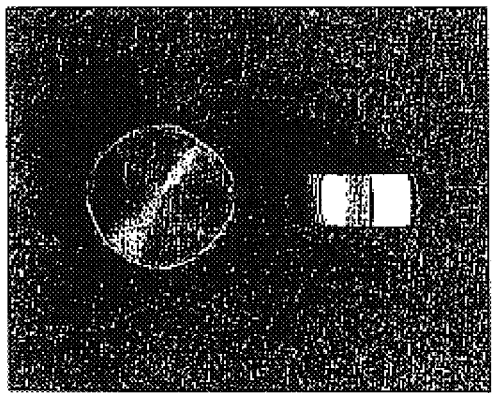
FIG. 6C illustrates a picture of a fracture pattern of a disclosed sample e(W—Cu) in FIG. 5.

FIG. 6A illustrates a picture of a fracture pattern of sample (a)(93.8W-2.5Ni-3.7Fe) as illustrated in FIG. 5, FIG. 6B illustrates a picture of a fracture pattern of sample (b) (93.7W-1.5Ni-1.87Fe-3.0Mo), sample (c)(93.1W-1.1Ni-1.3Fe-4.5Mo), and sample (d)(92.0W-0.5Ni-1.0Fe-6.5Mo) as illustrated in FIG. 5, and FIG. 6C illustrates a picture of a fracture pattern of a disclosed sample (e) (W—Cu) as illustrated in FIG. 5.

Second Embodiment

A physical property change of a green blank of the sample (c) in the first embodiment of the present invention according to variation of sintering temperature is measured, and its results are shown in Table 2.

Physical properties change according to sintering temperature:

TABLE 2

Physical properties change according to sintering temperature:

| sintering temperature (Max. ° C.) | Tensile strength (kg/mm$^2$) | Hard.($H_R$C) | Compression test: Compression Yield (kg/mm$^2$) | Compression test: Fracture pattern | Compression test: Splinter count | Compression test: S-S curve | Density (g/cc) | Ref. |
|---|---|---|---|---|---|---|---|---|
| 1,390 | 41 | 35.5 | 97 | | Perfect micro splinters | | 17.58 | Maintained 2 hours at max. temp. |
| 1,410 | 53 | 34.5 | 90 | | 12 | | 17.68 | |
| 1,430 | 63 | 32.6 | 76 | | 10 | | 17.69 | |
| 1,450 | 74 | 31.6 | 68 | | 8 | | 17.71 | |

Figure 7:
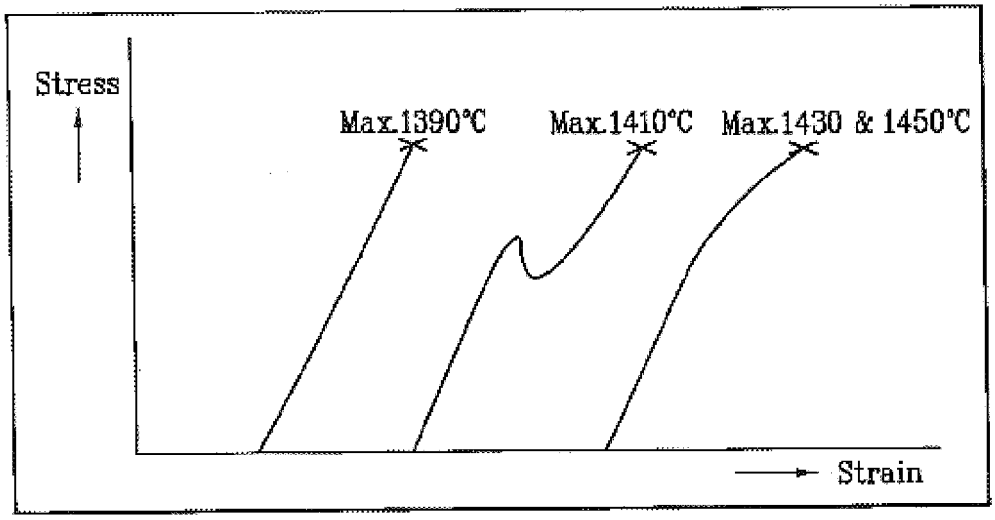
FIG. 7 illustrates a stress-strain graph of a compression strength test for the sample c(93.1W-1.1Ni-1.3Fe-4.5Mo) according to each sintering temperature.

A stress-strain graph of a compression strength test for the sample c (93.1W-1.1Ni-1.3Fe-4.5Mo) according to each sintering temperature is shown in FIG. 7.

Figure 8A:
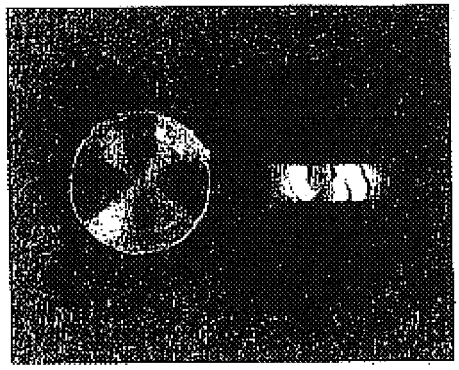
FIG. 8A illustrates a picture of a fracture pattern of the sample c in compression strength test according to a sintering temperature(1,390° C.)
Figure 8B:
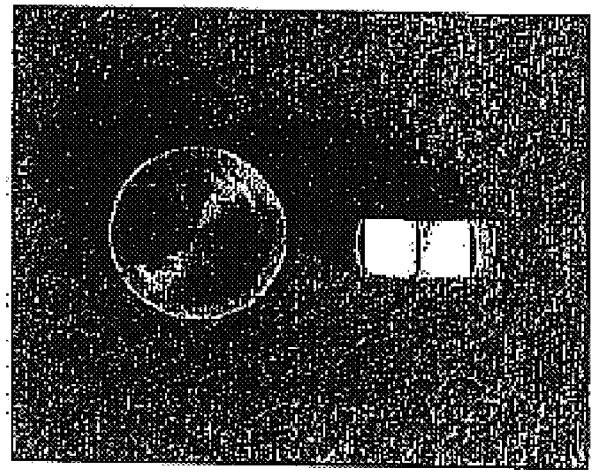
FIG. 8B illustrates a picture of a fracture pattern of the sample c in compression strength test according to a sintering temperature(1,410° C.)
Figure 8C:
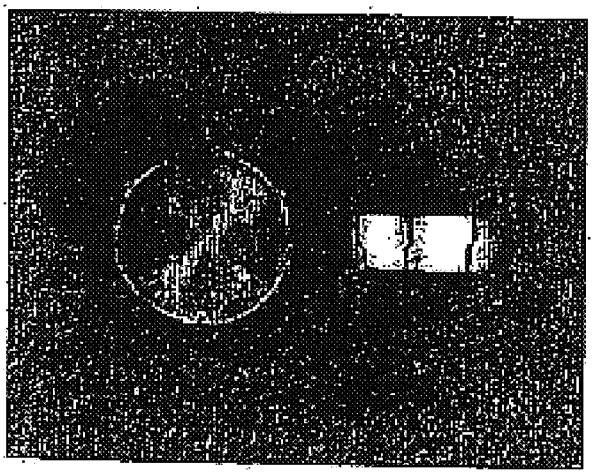
FIG. 8C illustrates a picture of a fracture pattern of the sample c in compression strength test according to sintering temperatures(1,390° C., 1,450° C.)

FIG. 8A illustrates a picture of a fracture pattern of the sample (c) in a compression test according to a sintering temperature of 1,390° C., FIG. 8B illustrates a picture of a fracture pattern of the sample (c) in compression strength test according to a sintering temperature of 1,410° C., and FIG. 8C illustrates a picture of a fracture pattern of the sample (c) in compression test according to sintering temperature of 1,450° C.

An effect that the sintering temperature has on the material characteristics is shown in Table 2. The stress-strain graph becomes curved as the temperature is higher on the same condition, a fracture pattern becomes step-like, a compression yield strength value decreases, and a tensile strength value increases.

Figure 4:
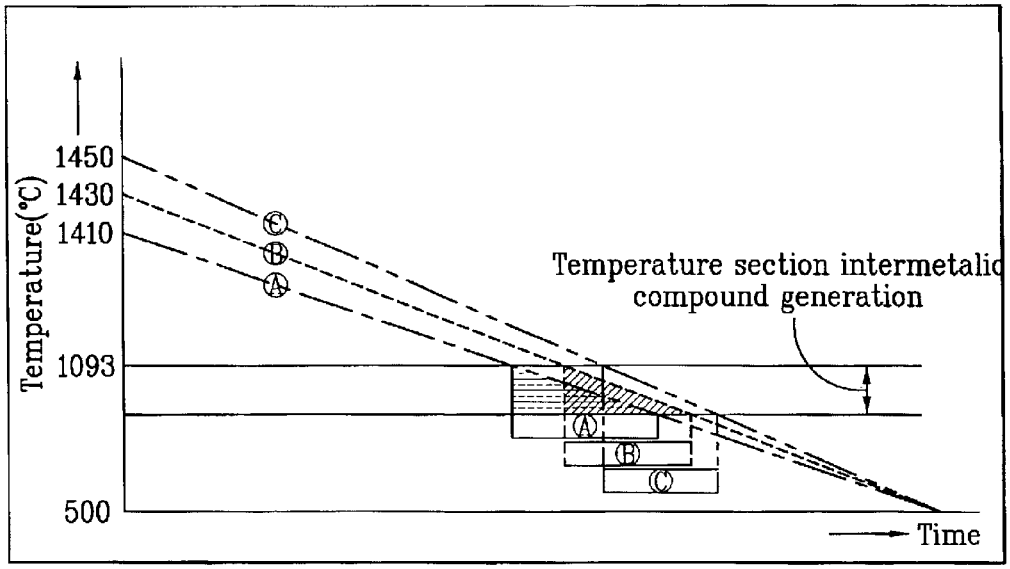
FIG. 4 illustrates a graph of forming an intermetallic compound according to a sintering temperature and a cooling condition of a tungsten heavy alloy material.

The breakage characteristics of the material differ from each other since the product amount of the intermetallic compound in the material varies according to a setup range of the sintering temperature. Namely, the intermetallic compound of the material is generated in the course of cooling. And, a generation section of an intermetallic compound according to a sintering temperature and a cooling condition of a tungsten heavy alloy material is shown in FIG. 4. Referring to FIG. 4, a generation time (c) in the course of cooling at high temperature(1,450° C.) is much shorter than a time (a) of generating intermetallic compound in the course of cooling at 1,410° C.

As shown in the test result, when the sintering temperature is higher, the tensile strength increases but the compression yield strength decreases. This means that the intermetallic compound tends to be produced less if cooling is carried out at the high temperature instead of the low temperature. In this case, the brittleness shows up less. However, if the sintering temperature is too low, the fracture pattern of the material fails to be straight but becomes totally broken. Hence, it is verified that 1,410° C. of the sintering temperature is optimum.

Third Embodiment

A physical property change of a green blank of the sample (c) in the first embodiment of the present invention according to variation of sintering time is measured, and its result is shown in Table 3.

Physical properties change according to sinterng time:

TABLE 3

Physical properties change according to sintering time:

| sintering time at max. temp. (hour) | Tensile strength (kg/mm$^2$) | Hard.($H_R$C) | Compression test: Compression Yield (kg/mm$^2$) | Compression test: Fracture pattern | Compression test: Splinter count | Compression test: S-S curve | Density (g/cc) | Ref. |
|---|---|---|---|---|---|---|---|---|
| 2.0 | 53 | 34.5 | 90 | | 12 | | 17.68 | Max. sintering temp. 1,410° C. |
| 3.5 | 69 | 32.4 | 78 | | 10 | | 17.65 | |
| 5.0 | 74 | 31.6 | 69 | | 8 | | 17.68 | |

Figure 9:
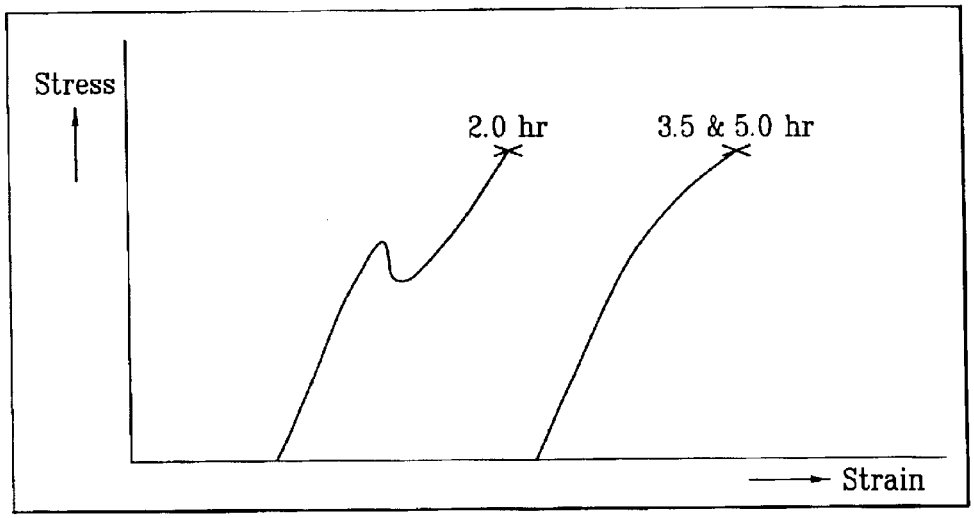
FIG. 9 illustrates a stress-strain graph of a compression strength test for the sample c(93.1W-1.1Ni-1.3Fe-4.5Mo) according to each sintering time.
Figure 10A:
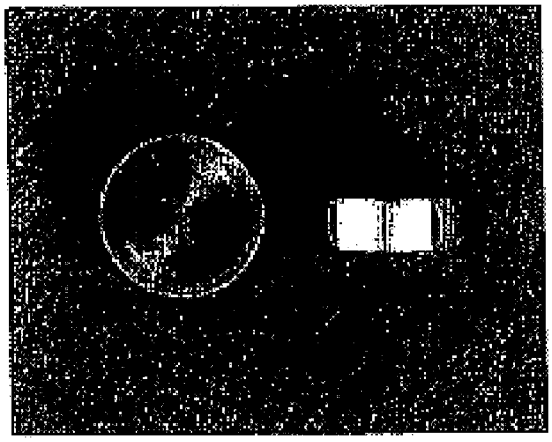
FIG. 10A illustrates a picture of a fracture pattern of the sample c at the sintering temperature of 1,410° C.) in compression strength test according to the sintering time(2 hours)
Figure 10B:
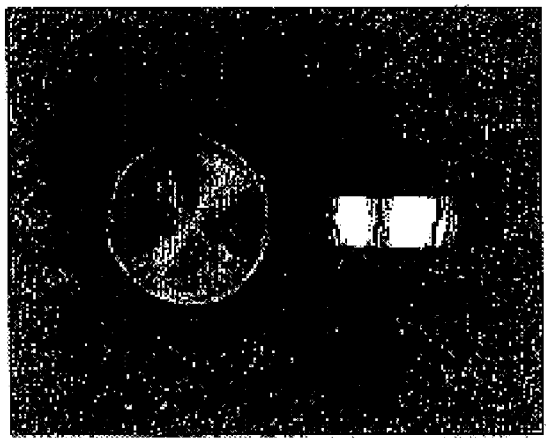
FIG. 10B illustrates a picture of a fracture pattern of the sample c at the sintering temperature of 1,410° C.) in compression strength test according to the sintering time(3.5 hours, 5 hours)

FIG. 9 illustrates a stress-strain graph of a compression test for the sample (c) (93.1W-1.1Ni-1.3Fe-4.5Mo) according to each sintering time, FIG. 10A illustrates a picture of a fracture pattern of the sample (c) M at the sintering temperature of 1,410° C. in compression test according to the sintering time (2 hours), and FIG. 10B illustrates a picture of a fracture pattern of the sample (c) at the sintering temperature of 1,410° C. in compression test according to the sintering time (3.5 hours, 5 hours).

Table 3 verifies that the material characteristics are affected by the variation of the sintering time. As the sintering time gets longer at the same temperature, the tenacity becomes higher. Namely, a tensile strength value increases but a compression yield strength value decreases. Specifically, a stress-strain graph is curved.

In the second and third embodiments of the present invention, the compression yield strength increases if the sintering temperature or time decreases.

Figure 11A:
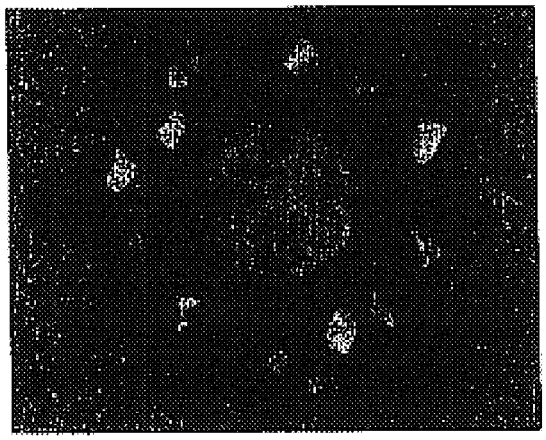
FIG. 11A illustrates a picture of splinter pieces after compression test of a disclosed material(W—Cu)
Figure 11B:
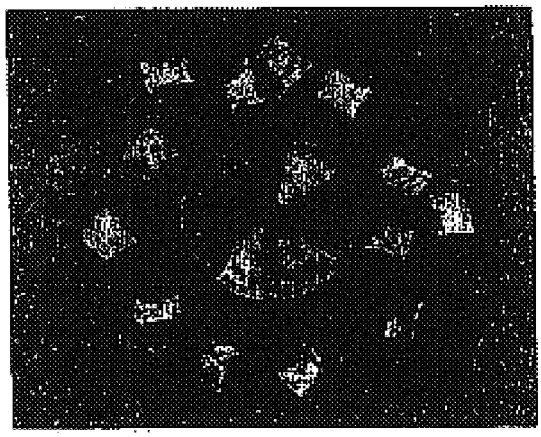
FIG. 11B illustrates a picture of splinter pieces after compression test of a material(93.1W-1.1Ni-1.3Fe-4.5Mo) of the present invention.

FIG. 11A illustrates a picture of splinter pieces after a compression test of a disclosed material (W—Cu) and FIG. 11B illustrates a picture of splinter pieces after a compression test of a material (93.1W-1.1Ni-1.3Fe-4.5Mo) of the present invention.

The material according to the present invention demanded in view of function prefers to be low in tensile strength. Yet, the material should be stable against the pressure of propellant inside a barrel when fired. The tensile strength is at least 47.0 kg/mm$^2$ and the compression yield strength is about 90 kg/mm$^2$. It is confirmed that the optimum conditions of the sintering temperature and time are max. 1,410° C. and approximately two hours, respectively.

Fourth Embodiment

A test of splinter-diffusing penetration performance is carried out on a tungsten heavy alloy according to the present invention. When an optimum composition ratio of a raw material powder and the micro structure and physical/mechanical properties of a pellet in the tungsten heavy alloy according to the embodiment of the present invention are examined, it is judged that the sample (c) meets the requirement of the demanded penetrator material characteristics. Hence, comparison tests of penetration are carried out on the sample (c) and the disclosed penetrator material of W—Cu. The test results are shown in Table 4.

| Penetrator material | Sample count(RDS) | Penetration diameter (Φ, mm) No. | Short axis | Long axis | Ref. |
|---|---|---|---|---|---|
| W-Cu | 10 | 1 | 100 | 130 | Measurements of penetration diameters of last targets arranged continuously |
| | | 2 | 80 | 80 | |
| | | 3 | 110 | 110 | |
| | | 4 | 100 | 110 | |
| | | 5 | 80 | 135 | |
| | | 6 | 130 | 150 | |
| | | 7 | 80 | 80 | |
| | | 8 | 100 | 120 | |
| | | 9 | 120 | 120 | |
| | | 10 | 100 | 110 | |
| | | Average | 98.0 | 114.5 | |
| Sample (c) (93.1W-1.1Ni-1.3Fe-4.5Mo | 10 | 1 | 150 | 150 | |
| | | 2 | 90 | 170 | |
| | | 3 | 100 | 120 | |
| | | 4 | 100 | 150 | |
| | | 5 | 100 | 120 | |
| | | 6 | 110 | 140 | |

-continued

| Penetrator material | Sample count(RDS) | Penetration diameter (Φ, mm) No. | Short axis | Long axis | Ref. |
|---|---|---|---|---|---|
| | | 7 | 180 | 200 | |
| | | 8 | 120 | 20 | |
| | | 9 | 100 | 110 | |
| | | 10 | 90 | 100 | |
| | | Average | 114.0 | 138.0 | |

In the test results of penetration performance, a penetration diameter of a liquid phase sintering product of W—Ni—FE—Mo includes short axis Φ114 mm~long axis Φ138 mm in average an the disclosed W—Cu material includes short axis Φ98 mm~long axis Φ114.5 mm.

Figure 13:
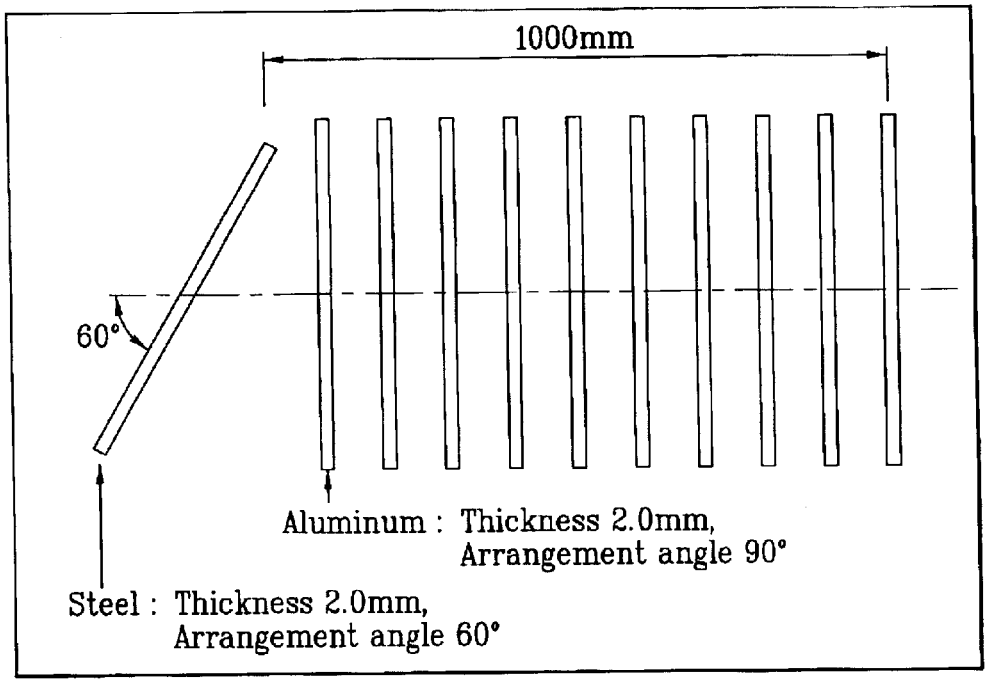
FIG. 13 illustrates a diagram of armored target arrangement of a penetrating splinter shell.
Figure 14A:
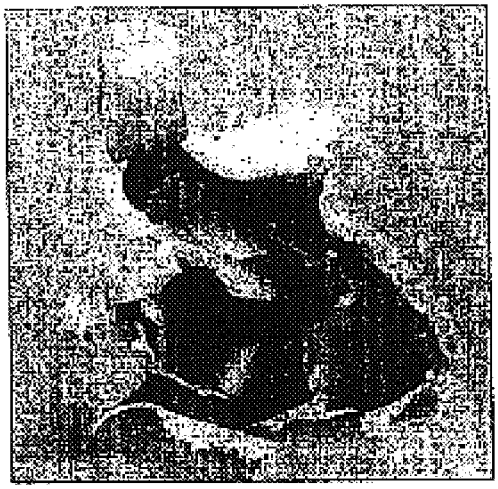
FIG. 14A illustrates a picture of a penetrated target by a disclosed material(W—Cu)
Figure 14B:
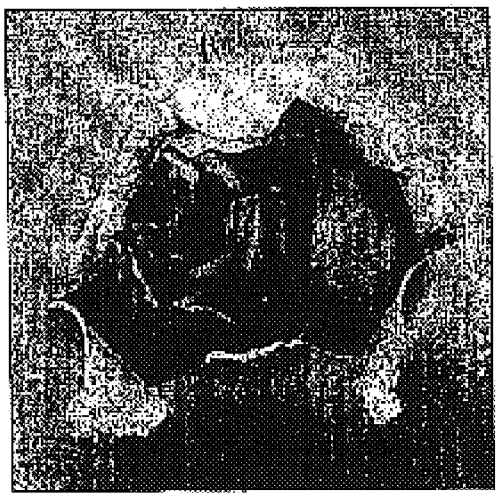
FIG. 14B illustrates a picture of a penetrated target by the sample (c) of the present invention.

FIG. 13 illustrates a diagram of an armored target arrangement of a penetrating splinter shell, FIG. 14A illustrates a picture of a penetrated target by a disclosed material (W—Cu), and FIG. 14B illustrates a picture of a penetrated target by the sample (c) of the present invention.

Accordingly, the present invention adjusts the overall composition ratio properly by adding Mo powder to tungsten heavy alloy powder and controls the sintering conditions, thereby enabling a change in the breakage characteristics of the material into brittle fracture from ductile fracture in accordance with the amount of the product of the intermetallic compound. Therefore, the present invention provides for a splinter shell on penetrator material that facilitates splinter diffusing penetration on the target at high speed impact.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. A tungsten heavy alloy penetrator material for penetrating a target with diffusing splinters comprising:

90–95 wt % W powder;

3.0–8.0 wt % Mo powder;

0.5–3.0 wt % Ni powder; and 1.0–4.0 wt % Fe powder, wherein the tungsten heavy alloy penetrator material is made by a method of comprising the steps of:

mixing 90–95 wt % W powder, 3.0–8.0 wt % Mo powder, 0.5–3.0 wt % Ni powder, and 1.0–4.0 wt % Fe powder;

compacting the mixed powders to form a green blank; and sintering the compacted green blank, wherein the tungsten heavy alloy penetrator material has a tensile strength of 40–75 k/cm$^2$ and a compression yield strength of 80–100 kg/cm$^2$.

2. The tungsten heavy alloy penetrator of claim 1, wherein the compacting step is carried out by Cold Isostatic Pressing.

3. The tungsten heavy alloy penetrator material of claim 1, wherein the sintering step is carried out for 2–5 hours at 1,350–1,450° C.

4. The tungsten heavy alloy penetrator material of claim 3, wherein the sintering step is carried out for 2–5 hours at 1,350–1,450° C.

* * * * *